US011981482B2

(12) United States Patent
Huang

(10) Patent No.: US 11,981,482 B2
(45) Date of Patent: May 14, 2024

(54) FLIP TOP LID WITH A REPLACEABLE THREADED DECORATIVE TOP

(71) Applicant: Po-Chun Huang, Taipei (TW)

(72) Inventor: Po-Chun Huang, Taipei (TW)

( * ) Notice: Subject to any disclaimer, the term of this patent is extended or adjusted under 35 U.S.C. 154(b) by 0 days.

(21) Appl. No.: 17/947,448

(22) Filed: Sep. 19, 2022

(65) Prior Publication Data

US 2024/0092544 A1 Mar. 21, 2024

(51) Int. Cl.
*B65D 51/24* (2006.01)
*B65D 47/08* (2006.01)

(52) U.S. Cl.
CPC ..... *B65D 51/245* (2013.01); *B65D 47/0857* (2013.01); *B65D 2251/0015* (2013.01); *B65D 2251/0087* (2013.01); *B65D 2251/06* (2013.01)

(58) Field of Classification Search
CPC ..... B65D 51/245; B65D 47/0857; B65D 2251/0015; B65D 2251/0087; B65D 2251/06
USPC ..... 220/376
See application file for complete search history.

(56) References Cited

U.S. PATENT DOCUMENTS 3,244,272 A * 4/1966 Beaman ..... G07D 9/004 206/0.82
5,636,740 A * 6/1997 Finkiewicz ..... B65D 81/366 220/837
6,902,304 B2 * 6/2005 Yang ..... B65D 39/16 362/101
7,665,607 B1 * 2/2010 Hanan ..... B65D 81/366 446/77
8,701,907 B1 * 4/2014 Mallicoat ..... B65D 51/245 81/3.4
2004/0052568 A1 3/2004 Gueret
2006/0211330 A1 9/2006 Cahill et al.
2017/0158388 A1 6/2017 Bentkovski
2017/0320640 A1 11/2017 Steinmann
2019/0177053 A1 * 6/2019 Duckworth ..... B65D 51/245

FOREIGN PATENT DOCUMENTS

KR 20090127391 12/2009
WO 2010/049151 5/2010

* cited by examiner

*Primary Examiner* — James N Smalley
(74) *Attorney, Agent, or Firm* — Alexander Chen, Esq.

(57) ABSTRACT

Disclosed in the present invention is a flip top lid with a replaceable threaded decorative top, comprising a flip top lid and a replaceable threaded decorative top. The flip top lid consists of a base unit and a flip top unit mounted or connected to the base unit at one side by a hinge structure. The replaceable threaded decorative top is connected and matched with the flip top unit through a threaded joint structure. The flip top unit is configured with a first threaded joint structure and the replaceable threaded decorative top is configured with a matching second threaded joint structure, so that the replaceable threaded decorative top can be tightly screwed on to the flip top unit and also quickly detached from the flip top unit. Through the flip top lid with a replaceable threaded decorative top, consumers will have the freedom to choose various appearance designs for their flip top bottles whenever they want, so as to enhance the aesthetic effect and to express their personal styles.

2 Claims, 4 Drawing Sheets

FLIP TOP LID WITH A REPLACEABLE THREADED DECORATIVE TOP

BACKGROUND OF INVENTION

1. Field of the Invention

The present invention relates to a flip top lid, and more particularly to a flip top lid with a replaceable threaded decorative top.

2. Description of Related Art

Flip top bottles and jars that commonly seen in the market are all provided with a flip top lid to seal the containers. A flip top lid consists of a base unit and a flip top unit mounted or connected to the base unit at one side by a hinge structure. Due to structure issues (especially the hinge structure), the flip top bottles offer few flip top styling designs. In addition, it is impossible to renew or replace the flip top unit as it is mounted or connected to the base unit. As a result, flip top lids usually have a monotonous appearance and have few design elements so it is hard for most users to distinguish their own water bottles from those of others. The flip top lids have neither beauty nor uniqueness, and easily cause confusion.

SUMMARY OF THE INVENTION

The first object of the present invention is to provide a flip top lid with a replaceable threaded decorative top. The replaceable threaded decorative top can provide unprecedented creative styling designs for the flip top lid. Comparing to the previous dull and monotonous designs, flip top lids can now have a variety of unique designs, offering more aesthetic and personal expression to meet individual needs and preferences of different consumers. Through the flip top lid with a replaceable threaded decorative top, consumers will have the freedom to choose various appearance designs for their flip top bottles whenever they want, so as to enhance the aesthetic effect and to express their personal styles. As a result, consumers will be more willing to carry their water bottles everywhere they go and reduce the purchase of disposable bottles, which is one of the most common everyday items that pollute the oceans.

Another object of the present invention is to provide the replaceable threaded decorative top combined with small electronic devices to provide functional features, such as telling the time, playing music, emitting light, positioning and tracking.

Another object of the present invention is to provide the replaceable threaded decorative top combined with small mechanic devices such as a music box or a surprise box.

In order to achieve the above objects, the inventor has developed a flip top lid with a replaceable threaded decorative top through a preferred embodiment, which comprises: a flip top lid and a replaceable threaded decorative top; the said flip top lid consists of a base unit and a flip top unit mounted or connected to the base unit at one side by a hinge structure; the said replaceable threaded decorative top is connected and matched with the flip top unit through a threaded joint structure. The flip top unit is configured with a first threaded joint structure and the replaceable threaded decorative top is configured with a matching second threaded joint structure, so that the replaceable threaded decorative top can be tightly screwed on to the flip top unit and also quickly detached from the flip top unit.

In one embodiment, the replaceable threaded decorative top is embedded with a small mechanic device or a small electronic device.

In one embodiment, the material of the flip top lid and the replaceable threaded decorative top includes but not limited to: silicone, plastics, rubber, glass, metal, precious metal, jade, wood, glaze, ceramics, leather, cloth, or any combination thereof.

DETAILED DESCRIPTION OF THE INVENTION

Figure 1:
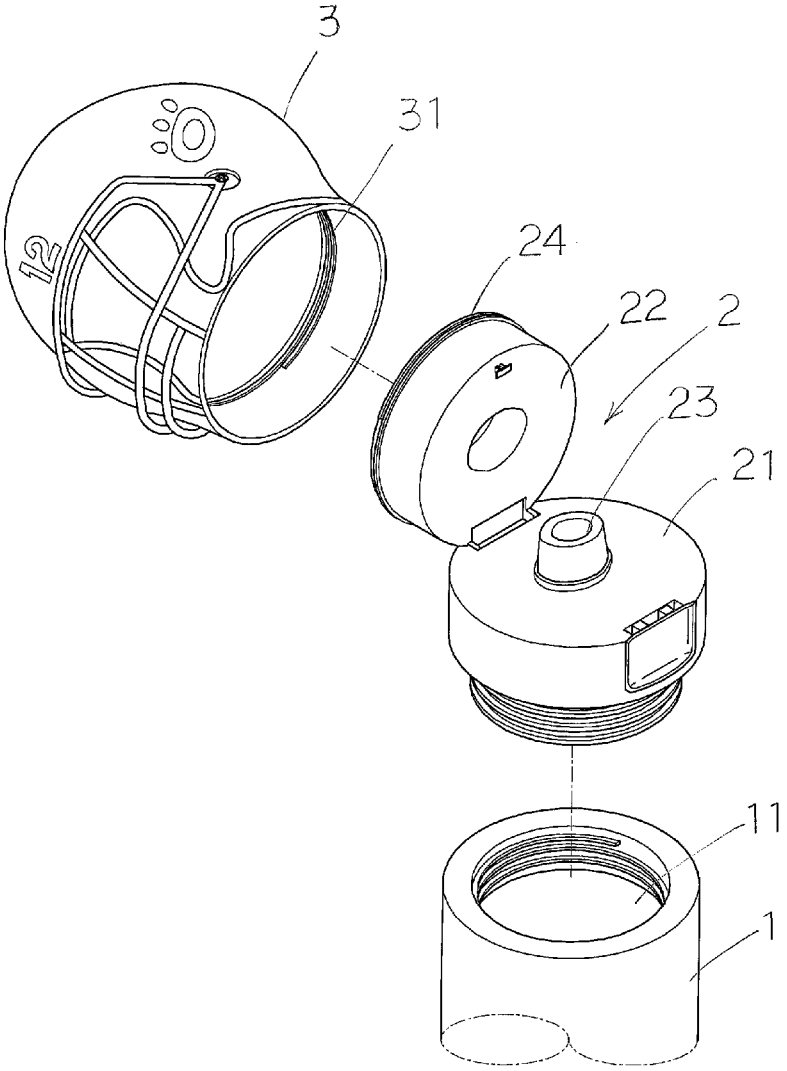
FIG. 1 is an exploded perspective view (I) of the container according to a preferred embodiment of the invention.
Figure 2:
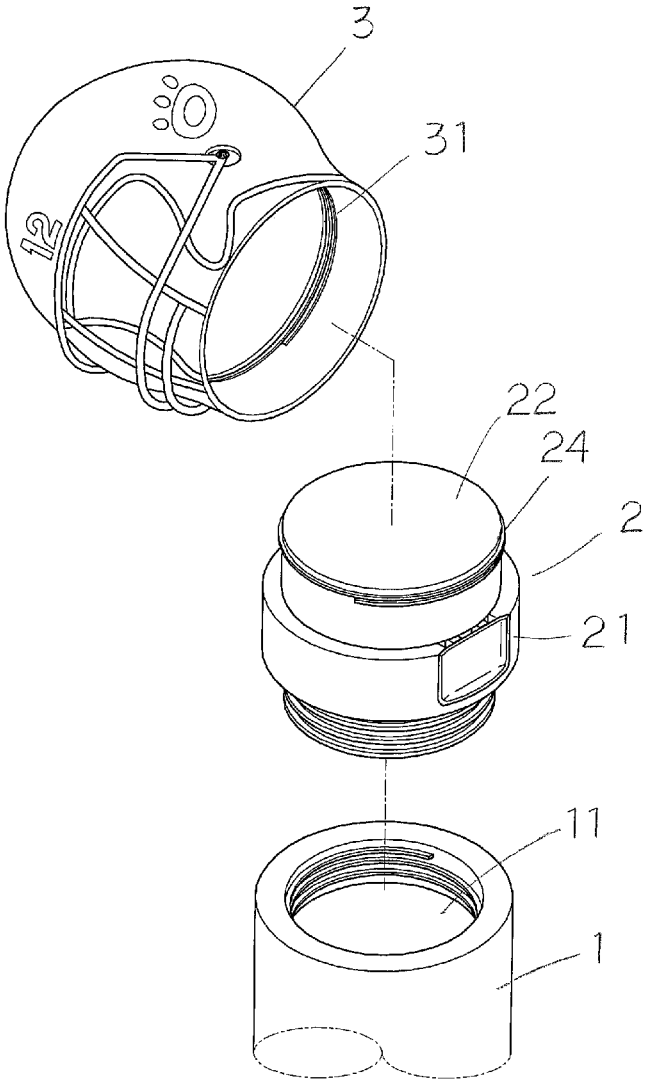
FIG. 2 is an exploded perspective view (II) of the container according to a preferred embodiment of the invention.
Figure 3:
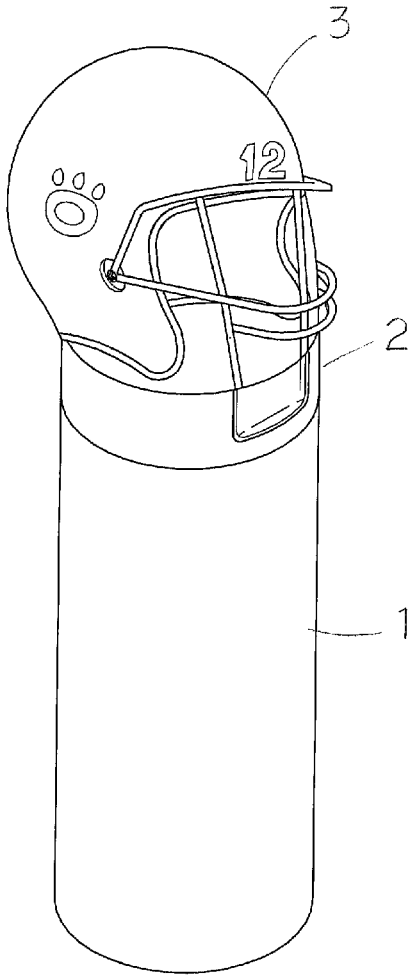
FIG. 3 is a schematic view of the overall appearance of the container according to a preferred embodiment of the invention.

Disclosed in FIG. 1 to FIG. 3 is a preferred embodiment of a flip top lid with a replaceable threaded decorative top according to the present invention, comprising: a flip top lid(2) and a replaceable threaded decorative top (3). The container (1) is cylinder-shaped with its one end having an opening (11). The opening (11) is connected with a flip top lid(2) through threaded joint. The replaceable threaded decorative top(3) has an appearance of any design, configured on the flip top lid(2). The flip top lid(2) is further made up of a base unit(21) and a flip top unit(22) mounted or connected to the base unit at one side by a hinge structure. The flip top lid has one hole for dispensing which is covered by the flip top unit when not in use. The flip top unit(22) is configured with a first threaded joint structure(24), and the replaceable threaded decorative top(3) is configured with a corresponding second threaded joint structure(31), so that the replaceable threaded decorative top(3) can be quickly and firmly combined with the flip top lid(2) and can also be detached easily and quickly from the flip top lid(2).

Figure 4:
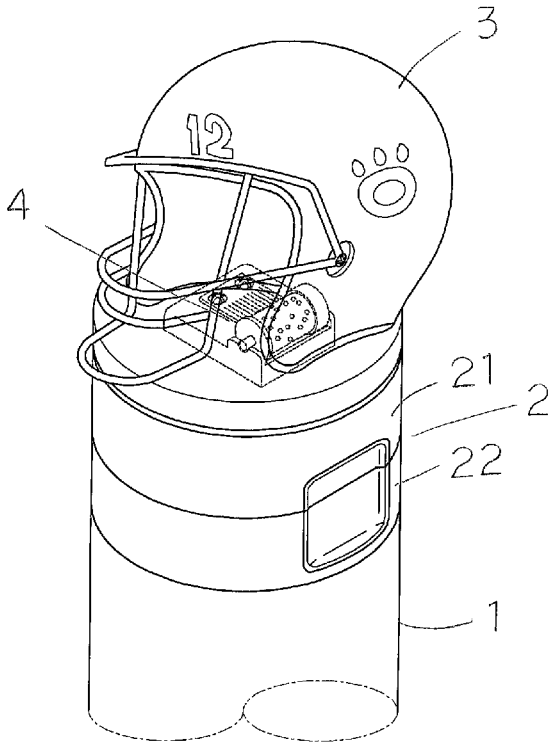
FIG. 4 is a schematic view of another implementation of the topper according to a preferred embodiment of the invention.

Now further referring to FIG. 4, the structural view of an embodiment of the replaceable threaded decorative top is disclosed. The replaceable threaded decorative top(3) can have any kind of design to act as the decoration of the flip top lid(2), and as a means to display personal style, taste, quality and aesthetics, and can be further combined with additional functions. For example, the replaceable threaded decorative top(3) can be embedded with: a small mechanic device (4) or a small electronic device. The small mechanic device (4) can be a music chip or an elastic doll, so that the replaceable threaded decorative top(3) can have the function of a music box or surprise box, with a lively effect and a value for collection. The small electronic device embedded in the replaceable threaded decorative top(3) includes: music playing unit and/or display, so that the replaceable threaded decorative top(3) can have additional functions including: clock, timer, music player, light emitter, positional, and tracker. Thus, in actual usage, a replaceable threaded decorative top(3) with a clock or timer can provide the user with the functions of time telling or alarm; a replaceable threaded decorative top(3) with a music player can provide the user with the function of playing music; a replaceable threaded decorative top(3) with a light emitter can provide the user with the function of a torch or a flash light to avoid collision at night; and a replaceable threaded decorative top(3) with a positioning or tracking device can be used to effectively track the user for safety, particularly when it comes to children or old people.

The material of the flip top lid(2) and the replaceable threaded decorative top(3) includes but not limited to: silicone, plastics, rubber, glass, metal, precious metal, jade, or any combination thereof, to offer various functional options and to meet diversified consumer needs.

Although the invention has been explained in relation to its preferred embodiment, it is to be understood that many other possible modifications and variations can be made without departing from the spirit and scope of the invention as hereinafter claimed.

The invention claimed is:

1. A flip top lid comprising a lid unit and a replaceable threaded decorative top;

wherein said lid unit comprising a top half portion and a bottom half portion mechanically connected by a hinge such that said top half portion flips up when in an open position;

wherein said top half portion is comprised of a cylindrical vertical wall forming a solid body having a top floor on the one end and a bottom on the other end;

wherein said bottom half portion having an upward hollow spout formed in the center of bottom half portion; wherein said upward hollow spout is formed as a single integrated unit with said bottom half portion; wherein said bottom floor of said top half portion having an matching opening allowing said upward hollow spout to protrude into said top half portion, wherein said vertical wall is even in length in all portions of said body and at least as tall as said upward hollow spout;

wherein said replaceable threaded decorative top is connected and matched to said top half of said lid unit through a threaded joint structure wherein said top half is configured with a first threaded joint structure, and said replaceable threaded decorative top is configured with a corresponding second threaded joint structure, so that said replaceable threaded decorative top can be attached to said top half.

2. The flip top lid with a replaceable threaded decorative top defined in claim 1, wherein the material of said flip top lid and said replaceable threaded decorative top includes but not limited to silicone, plastics, rubber, glass, metal, precious metal, jade, wood, glaze, ceramics, leather, cloth, or any combination thereof.

* * * * *